US008074308B2

(12) United States Patent
Brinkerhoff et al.

(10) Patent No.: US 8,074,308 B2
(45) Date of Patent: Dec. 13, 2011

(54) CHAIR STABILIZER FOR REFRACTIVE SURGERY

(75) Inventors: Mark Brinkerhoff, San Jose, CA (US); Tom Kowalski, Ben Loman, CA (US); Shandon Alderson, San Jose, CA (US)

(73) Assignee: AMO Manufacturing USA, LLC., Santa Ana, CA (US)

( * ) Notice: Subject to any disclaimer, the term of this patent is extended or adjusted under 35 U.S.C. 154(b) by 0 days.

(21) Appl. No.: 12/683,580

(22) Filed: Jan. 7, 2010

(65) Prior Publication Data

US 2010/0095455 A1 Apr. 22, 2010

Related U.S. Application Data

(62) Division of application No. 11/342,278, filed on Jan. 27, 2006, now Pat. No. 7,661,161.

(51) Int. Cl.
*A47B 7/02* (2006.01)

(52) U.S. Cl. ..... 5/608; 5/601; 5/611; 5/11

(58) Field of Classification Search ..... 5/601, 11, 5/611, 608; 378/209
See application file for complete search history.

(56) References Cited

U.S. PATENT DOCUMENTS

| | | | |
|---|---|---|---|
| 2,251,797 | A | 8/1941 | Leland |
| 4,361,916 | A | 12/1982 | McDaniel |
| 4,558,857 | A | 12/1985 | Heller |
| 4,840,363 | A | 6/1989 | McConnell |
| 5,013,018 | A | 5/1991 | Sicek et al. |
| 5,144,630 | A | 9/1992 | Lin |
| 5,657,498 | A | 8/1997 | Hum |
| 5,742,626 | A | 4/1998 | Mead et al. |
| 5,794,286 | A | 8/1998 | Scott et al. |
| 6,094,760 | A | 8/2000 | Nonaka et al. |
| 6,574,808 | B1 | 6/2003 | Brown et al. |
| 6,721,976 | B2 | 4/2004 | Schwaegerle |
| 7,120,223 | B2 | 10/2006 | Nafstadius |
| 7,181,792 | B2 | 2/2007 | Nakamura et al. |
| 7,451,507 | B2 | 11/2008 | Brinkerhoff et al. |
| 7,661,161 | B2 | 2/2010 | Brinkerhoff et al. |
| 2003/0004500 | A1 | 1/2003 | Clapham |
| 2005/0028280 | A1 | 2/2005 | Nakamura et al. |

*Primary Examiner* — Michael Trettel
*Assistant Examiner* — William Kelleher

(57) ABSTRACT

Devices, systems, and methods for supporting and/or stabilizing a patient can help to position a patient relative to a therapeutic laser beam, for example, inhibiting motion or deflection during a refractive procedure on the eyes, and the like. A stabilizing structural member can support a chair or other patient support near shoulders of the patient, and the member may remain stationary while the chair is driven in a horizontal plane by a linkage. Often, a nominal patient center of gravity is located between the support member and a portion of the patient support which is supported by the linkage to reduce cantilever effects. The member may be rigidly attached to a vertical motion stage which moves the chair at an angle, for example at an angle normal to the horizontal plane.

7 Claims, 10 Drawing Sheets

CHAIR STABILIZER FOR REFRACTIVE SURGERY

CROSS REFERENCE TO RELATED APPLICATION DATA

The present application is a divisional of U.S. Ser. No. 11/342,278 filed Jan. 27, 2006; the full disclosure of which is incorporated herein by reference in its entirety.

BACKGROUND OF THE INVENTION

The present invention relates generally to devices, systems, and methods for supporting and positioning patients, particularly for performing refractive surgery on eyes and the like. Embodiments of the present invention provide an improved patient support structure (such as a chair, bed, or table) which can help to stabilize the patient and/or minimize motion adjacent the head of the patient. Other embodiments provide mechanisms for positioning the head and body of a patient and stabilizing the patient support, providing improved patient stability during surgery. The invention may be particularly useful for enhancing the speed, ease, safety, and efficacy of laser eye surgical procedures such as photorefractive keratectomy ("PRK"), laser in situ keratomileusis ("LASIK"), and the like.

Laser eye surgical procedures typically employ ultraviolet or infrared lasers to remove a microscopic layer of stromal tissue from the cornea to alter the cornea's refractive properties. Excimer laser systems generally use argon and fluorine gas to create a non-thermal laser light which can break molecular bonds in a process known as photoablation. Such systems result in the photodecomposition of the corneal tissue, but generally do not cause significant thermal damage to adjacent and underlying tissues of the eye. The photoablation removes the stromal tissue to change the shape or contour of the cornea and can be used to correct myopia (near-sightedness), hyperopia (far-sightedness), astigmatism, high-order aberrations, and the like.

Existing laser eye surgery systems have generally included an operator interface for use by the laser system operator in setting up, controlling, monitoring, and generally directing the laser treatment of the patient's eyes. Accurate photoablation of corneal tissues benefits from precise alignment between the eye and the therapeutic laser beam transmitted from the laser system. Many laser eye surgical alignment systems have a patient seat over bed so that the patient is treated while seated, while lying down, or while reclined in a supine position. To align the patient with the laser beam delivery optics, the system operator generally positions the seat or bed into alignment with the laser system. A particularly advantageous user interface and patient support system is described in U.S. patent application Ser. No. 10/226,867, entitled "Improved Interface for Laser Eye Surgery" as filed on Aug. 20, 2002, the full disclosure of which is incorporated herein by reference. Embodiments of that advantageous system make use of a contoured patient treatment chair to help position a patient into nominal alignment with the laser, allowing the system operator to make fine adjustments using the system interface. As the system can be moved quickly to the nominal alignment for treatment of the left or right eyes, this improved interface system provides significant advantages in ease of use, overall procedure speed, and alignment accuracy. Another patient support system is described in U.S. patent application Ser. No. 11/335,177, entitled "Compression Head Pillow and Neck Angle Adjustment Mechanism for Refractive Laser Surgery and the Like" as filed on Jan. 18, 2006, the full disclosure of which is incorporated herein by reference. Embodiments of that system may allow both the height of the patient's head and the angle of the patient's neck to be established independently, and/or may inhibit movement or deflection of the head of the patient from an aligned position.

While known patient support and user interface systems have allowed a large number of patients to benefit from the advantages of laser eye surgery, still further improvements would be desirable. For example, it would be advantageous to more accurately position the patient into alignment with laser system and inhibit movement of the patient from the aligned configuration. It would also be advantageous to accommodate the wide range of patient physiologies, ideally without decreasing the speed or increasing the complexity of the alignment procedure. Preferably, these benefits would be provided without decreasing the system operator's access to the patient. At least some of these potential advantages may be realized by the systems, devices, and methods described herein below.

BRIEF SUMMARY OF THE INVENTION

The present invention generally provides improved devices, systems, and methods for supporting and/or stabilizing a patient. Exemplary embodiments provide patient support structures (most often being motor-driven patient chairs, beds, tables, or the like). The support structures described herein are often well suited for use in refractive surgery, for example by allowing a system operator or automated controller to position a patient relative to a therapeutic laser beam, and inhibiting inadvertent or unintended motion or deflection of the patient (and particularly the head of the patient) during a procedure. One exemplary embodiment includes a patient chair mounted to a three degree-of-freedom motorized linkage pedestal near the center of the chair. A structural support member helps support the chair, and remains stationary while the chair is driven in a horizontal plane, optionally using a planar engagement surface on either the chair or member to accommodate the horizontal movement. Often, a nominal patient center of gravity is located between the support member and the pedestal to reduce cantilever effects. The member may be rigidly attached to a vertical motion stage of the pedestal so that the member moves upward and downward with the chair.

In a first aspect, the invention provides a patient positioning system. The system includes a base, and a patient support having a first portion and a second portion. A linkage movably supports the patient support relative to the base. The linkage is attached to the first portion of the support. The patient support is movable within a plane, for example a horizontal plane. A member having a bearing surface supports the second portion of the patient support while the patient support moves within the plane and the member remains at a fixed location.

In exemplary embodiments the linkage also moves the patient support along a dimension which crosses the plane at an angle, so that the linkage moves the patient support at an angle to the plane. In specific embodiments, the linkage moves the patient support at an angle which is normal to the plane. For example, the linkage can move with the patient support in a horizontal XY plane and the linkage can also move the patient support along a vertical Z dimension which crosses the horizontal XY plane at an angle normal to the horizontal XY plane. The member may be attached to the linkage so as to move the member, for example vertically, so that the bearing surface may remain at a fixed XY location relative to the horizontal plane even during vertical movement. The linkage can comprise, for example, a three degree of freedom motorized pedestal and the patient support may comprise a chair mounted to the pedestal near a center of gravity of the chair.

The linkage may include a vertical motion stage and a horizontal motion stage. In many embodiments, the vertical motion stage supports the horizontal motion stage, with the vertical motion stage moving the patient support at an angle to the plane.

In many embodiments, the vertical motion stage is rigidly affixed to the member. The bearing surface can be located toward a head of a patient from the first portion of the patient support. The patient support can be contoured to receive the patient at a nominal position having a nominal center of gravity of the patient. The nominal patient center of gravity can be located between the first portion of the support and the second portion of the support. The support may rotate about the base with a vertical axis of rotation passing through the base. The bearing surface may be separated from the axis of rotation by a distance of at least one foot.

In many embodiments, the bearing surface comprises and/or engages a planar surface extending substantially along the plane so as to maintain support with the bearing surface during movement along the plane. In a specific embodiment, the planar surface is angularly deflected from the plane (for example, at an angle less than ten degrees relative to the plane), so as to compensate for changes in loads to the member induced by movement along the plane, including when the patient center of gravity moves and increases loading of the bearing surface.

In specific embodiments, a flat plate is positioned at the bottom of the second portion of the support. The flat plate engages the bearing surface. The bearing surface may be located on a rotating ball which engages the flat plate. The rotating ball supports the flat plate while the bearing surface of the member remains at a fixed location. The plate and the bearing surface may disengage while the support rotates about the axis rotation during the loading or unloading of a patient.

In alternate embodiments, the linkage moves the first portion of the patient support at an angle to the plane, for example normal to the plane. The member is coupled to the linkage to move the member at the angle to the plane. A threaded rod may couple the linkage to the member and rotate while the member moves the second portion of the support at the angle to the plane.

In another aspect, the invention provides a method of stabilizing a patient support for laser refractive surgery. The method comprises supporting the patient support with a linkage. The linkage has a first end attached to a base and a second end attached to a first portion of the support. A second portion of the patient support is supported with a bearing surface of a member. The patient support moves along a plane by articulating the linkage while the bearing surface of the member remains at a fixed location.

In some embodiments, the patient support and the member may be moved at an angle to the plane by a vertical motion stage of the linkage. The patient support may be moved along the plane by a horizontal motion stage of the linkage. The horizontal motion stage may support the member while the patient support moves along the plane and the vertical motion stage remains at a fixed location. A patient may rest upon the support and may have a patient center of gravity located between the first portion of the support and the second portion of the support. The support may rotate about an axis of rotation passing through the base. A flat surface may comprise or engage the bearing surface, such as by using a plate affixed to the patient support to movably engage the bearing surface. A ball may comprise the bearing surface and be rotated so as to accommodate movement of the patient support along the plane.

In specific embodiments, the first portion of the patient support moves at an angle to the plane by moving a vertical motion stage of the linkage at the angle to the plane, and the member moves at the angle to the plane synchronous with the moving of the vertical motion stage. For example, the member can be coupled with the vertical motion stage to move the member synchronous with the vertical motion stage. In a specific embodiment, rotating a threaded rod moves the member at the angle to the plane such that the member moves at the angle to the plane synchronous with the vertical motion stage.

DETAILED DESCRIPTION OF THE INVENTION

The present invention generally provides improved devices, systems, and methods for supporting, positioning, and inhibiting inadvertent or undesired movements of patients. While the invention may find applications in a wide variety of settings, including for surgeries of the face, diagnostic measurements, and patient repositioning after injuries, the most immediate application for embodiments of the invention may be during refractive procedures such as laser eye surgery and the like. Advantageously, the structures and methods described herein may provide improved patient stability, particularly near the head or feet of the patient. In many embodiments, positioning and inhibiting movement of the patient may be achieved by providing an additional load bearing member offset from a motorized linkage. For example, the load bearing member can be disposed near the shoulders of the patient while the linkage supports the hips of the patient so that the nominal center of gravity of the patient is located between the supports, thereby reducing motion and cantilever effects.

Figure 1:
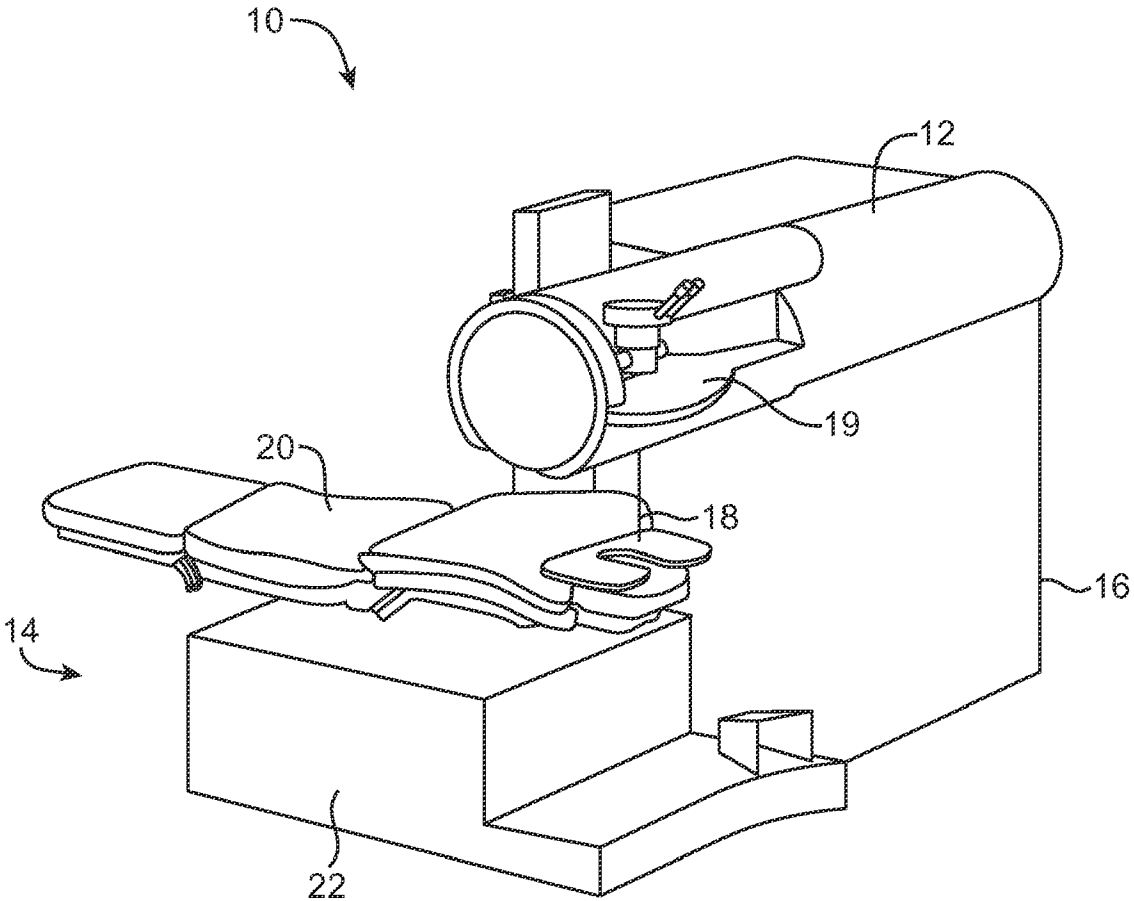
FIG. 1 is a perspective view schematically illustrating a laser eye surgery system having a patient support.

Referring now to FIG. 1, an exemplary laser eye surgery system 10 generally includes a laser system 12 and a patient positioning system 14. Laser system 12 includes a housing 16 that includes both a laser and system processor. The laser generates a laser beam 18 which is directed to a patient's eye for the processor under the direction of a system operator. Delivery optics used to direct the laser beam, the microscope mounted to the delivery optics, and the like may employ existing structures from commercially available laser systems, including at least some portions of the STAR S4 ACTIVE TREK™ excimer laser system and other laser systems available from Advanced Medical Optics, Inc. of Santa Clara, Calif.

The system operator interface for laser system 12 may include an input device 19 which can be used to help align laser beam 18 in relation to an eye of a patient P. The microscope can be used to image a cornea of the eye, with the user interface optionally including a joy stick (or any of a variety of alternative input components such as a track ball, touch screens, or any of a wide variety of alternative pointing devices). Input to the processor of laser system 12 may also be provided a keypad, data transmission links such as an Ethernet, an intranet, the Internet, a modem, wireless devices, or the like.

Figure 2:
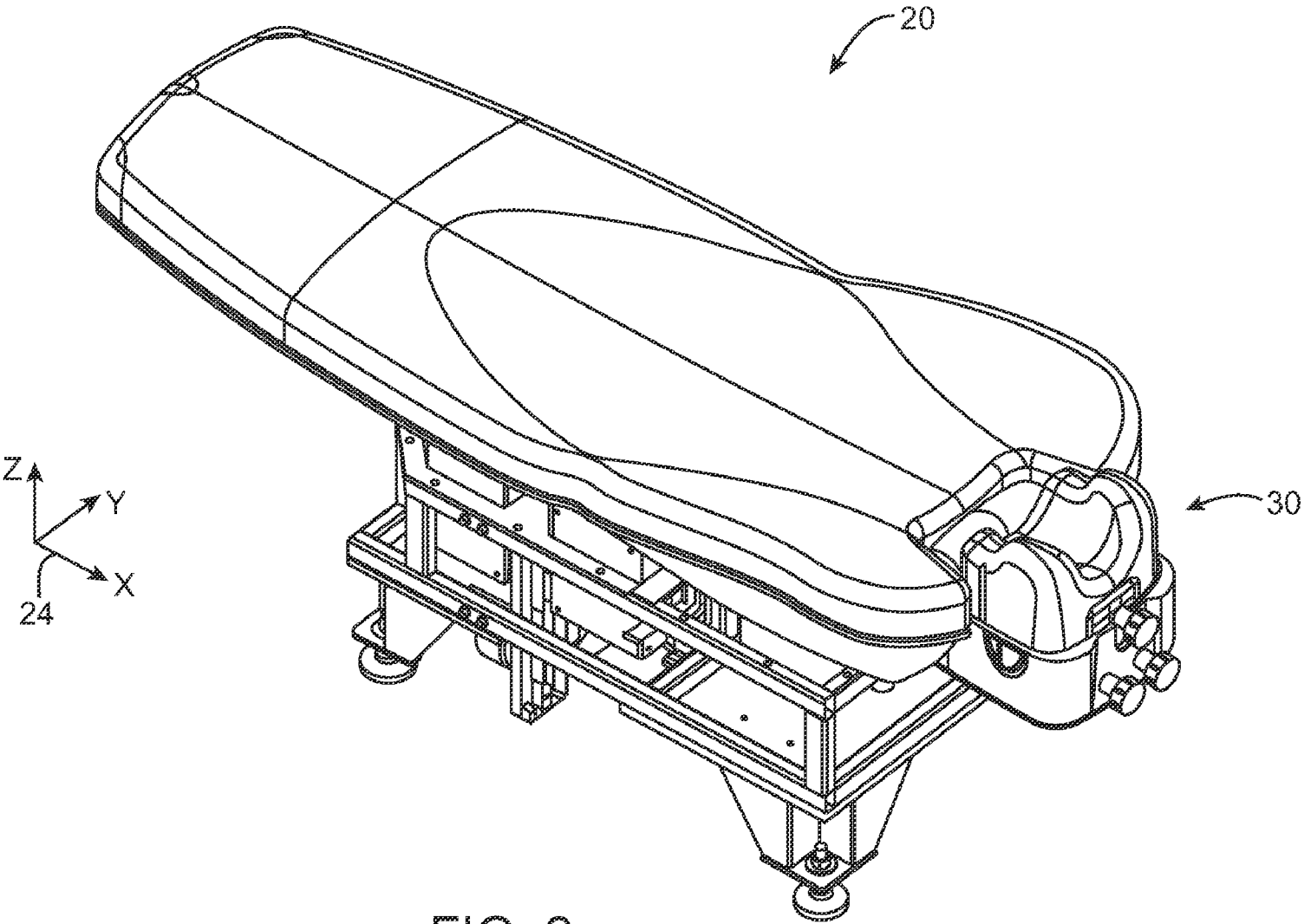
FIG. 2 is a perspective view of a patient support for use in the laser eye surgery system of FIG. 1, in which the patient support has a headrest and neck rest which move vertically, and a compressive head pillow which restrains movement of the head during laser eye surgery.

In addition to (or in some cases, instead of) adjustments to the delivery optics directing laser beam 18, alignment between the patient and the laser treatment may be provided at least in part by patient positioning system 14. Patient positioning system 14 generally includes a patient chair 20 and a patient support movement mechanism 22. Patient chair 20 may be contoured, helping to position the patient at a nominal location on the patient support such that the patient support defines nominal optical axes near the locations of the patient's left and right eyes. Patient chair 20 may comprise a bed, patient seat, or reclining patient seat. Movement mechanism 22 may allow patient chair 20 to move clear of the laser system 12 to facilitate loading and unloading of the patient onto the patient support, and may move the patient support quickly to a nominal left or right eye treatment position in which the nominal optical axes defined by the patient support are aligned with laser beam 18. Fine adjustments of the position of patient chair 20 may then be effected using fine motion control of movement mechanism 22 so as to more accurately align the patient with the laser system, as more fully described in U.S. patent application Ser. No. 10/226,867 filed Aug. 20, 2002, the full disclosure of which has previously been incorporated herein by reference. In preferred embodiments, patient char 20 provides patient movement along three dimensions of a chair coordinate reference 24. As shown in FIG. 2, chair 20 provides horizontal movement along an XY plane of chair coordinate reference 24 and vertical motion along a Z dimension of chair coordinate reference 24. Vertical motion along dimension Z of coordinate reference 24 is normal and at a 90 degree angle to the XY plane in preferred embodiments. In other embodiments, motion of the chair is at another angle to the XY plane.

The laser of laser system 12 will often comprise an excimer laser, ideally comprising an argon-fluoride laser producing pulses of laser light having a wavelength of approximately 193 nm. Each pulse of laser beam 18 preferably removes a microscopic layer of tissue, with the processor of laser system 12 scanning the pulses and/or profiling the pulses transmitted towards the patient's eye according to a pattern of pulses so as to resculpt the patient's cornea. Alternative laser or other electromagnetic radiation forms might also be used, particularly those well-suited for controllably ablating or reshaping corneal tissue without causing significant damage to adjacent and/or underlying tissues of the eye. Such laser systems may include solid state lasers, including frequency multiplied solid state lasers such as flash-lamp and diode pumped solid state lasers. Exemplary solid state lasers include UV solid state lasers having wavelengths of approximately 193-215 nm such as those described in U.S. Pat. Nos. 5,144,630 and 5,742,626.

In addition to lateral alignment between the patient and delivery optics of laser system 12, patient chair 20 may also be used to help vertically position the patient (and more specifically, the eye of the patient) at a desired treatment location along the axis of laser beam 18. Such vertical adjustment of the patient or patient's eye can facilitate accurate ablation, imaging of the eye with the microscope of laser system 12, tracking movements of the eye so as to maintain alignment between laser beam 18 and the eye, and the like. In addition to providing vertical alignment, patient chair 20 may also be used to orient the face and eye of the patient with the delivery optics and laser beam 18. While the patient will often be viewing a fixation target incorporated into the laser delivery optics of laser system 12 so as to help maintain the eye at the proper orientation relative to the therapeutic laser beam, having the patient's head at an appropriate orientation may facilitate access to the corneal tissue free from interference from the upper or lower eyelids, and the like. Proper orientation of the head may also make it easier for the patient to maintain viewing fixation on the fixation target.

Referring now to FIGS. 1 and 2, patient chair 20 can be seen in more detail in accordance with preferred embodiments. In some embodiments, the patient support may be articulated, optionally having a hinge or the like allowing the patient's legs or feet to be lowered independently of the torso. In many embodiments, a head support and/or restraint mechanism 30 may be provided. Exemplary head supports may take a variety of forms, optionally having head pad surfaces which are moderately contoured with a recess to receive the back of the patient's head, having variable stiffness surfaces, such as those provided by sealed head pad structures containing beads or the like which assume a more rigid configuration when a vacuum is applied, or having a highly contoured and articulated head pad structure that can apply gentle lateral compression to the sides of the head to inhibit movement of the head. In many embodiments, the position of head pad 30 relative to the other portions of patient chair 20 may be moved, often by articulating one or more linkages. Exemplary head supports are more fully described in U.S. patent application Ser. No. 11/335,177 filed on Jan. 18, 2006, the full disclosure of which has been previously incorporated herein by reference.

Figure 3:
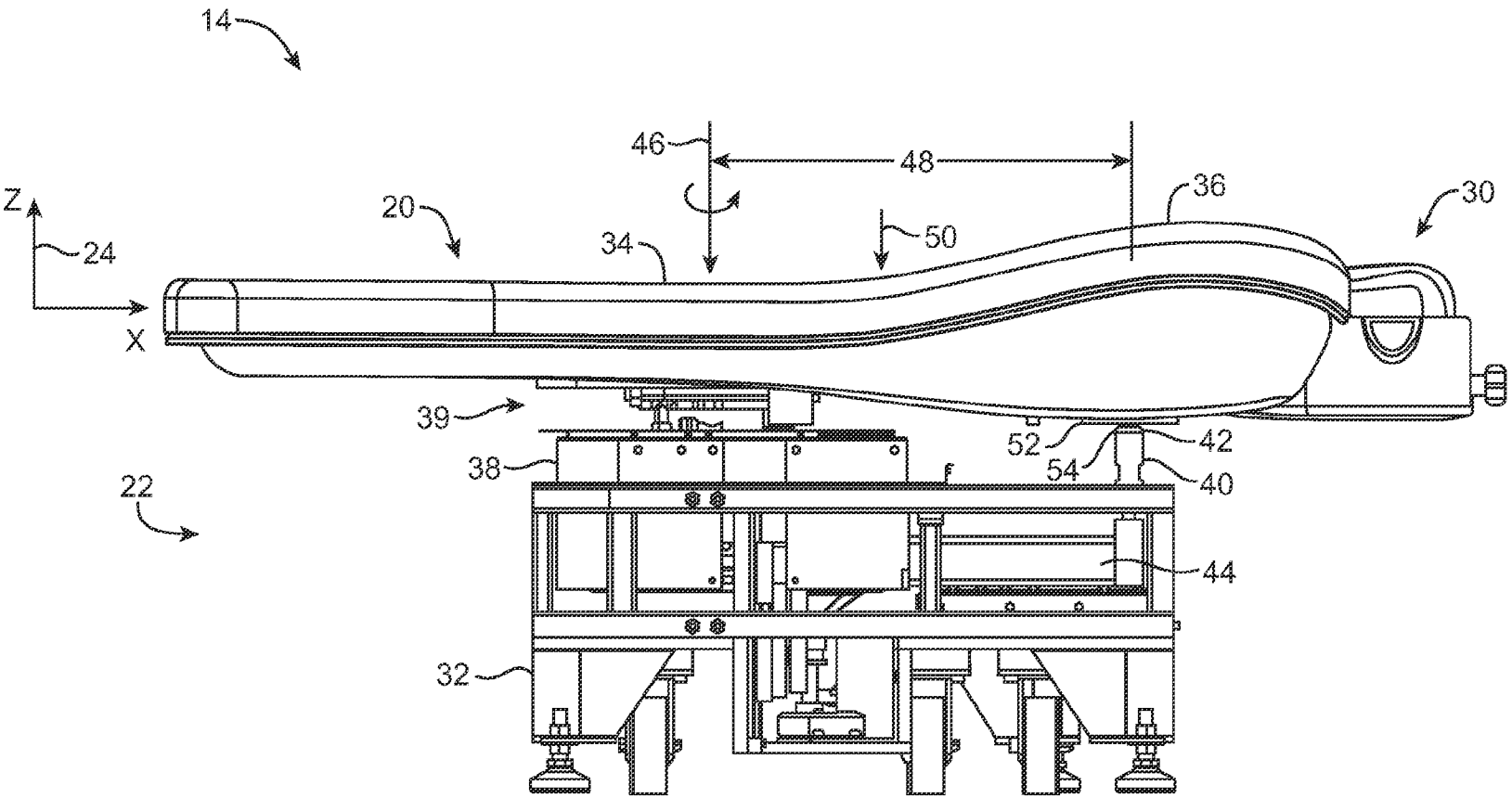
FIG. 3. is a plan view of a patient support as in FIG. 2 having a stabilizing support in accordance with embodiments.
Figure 4:
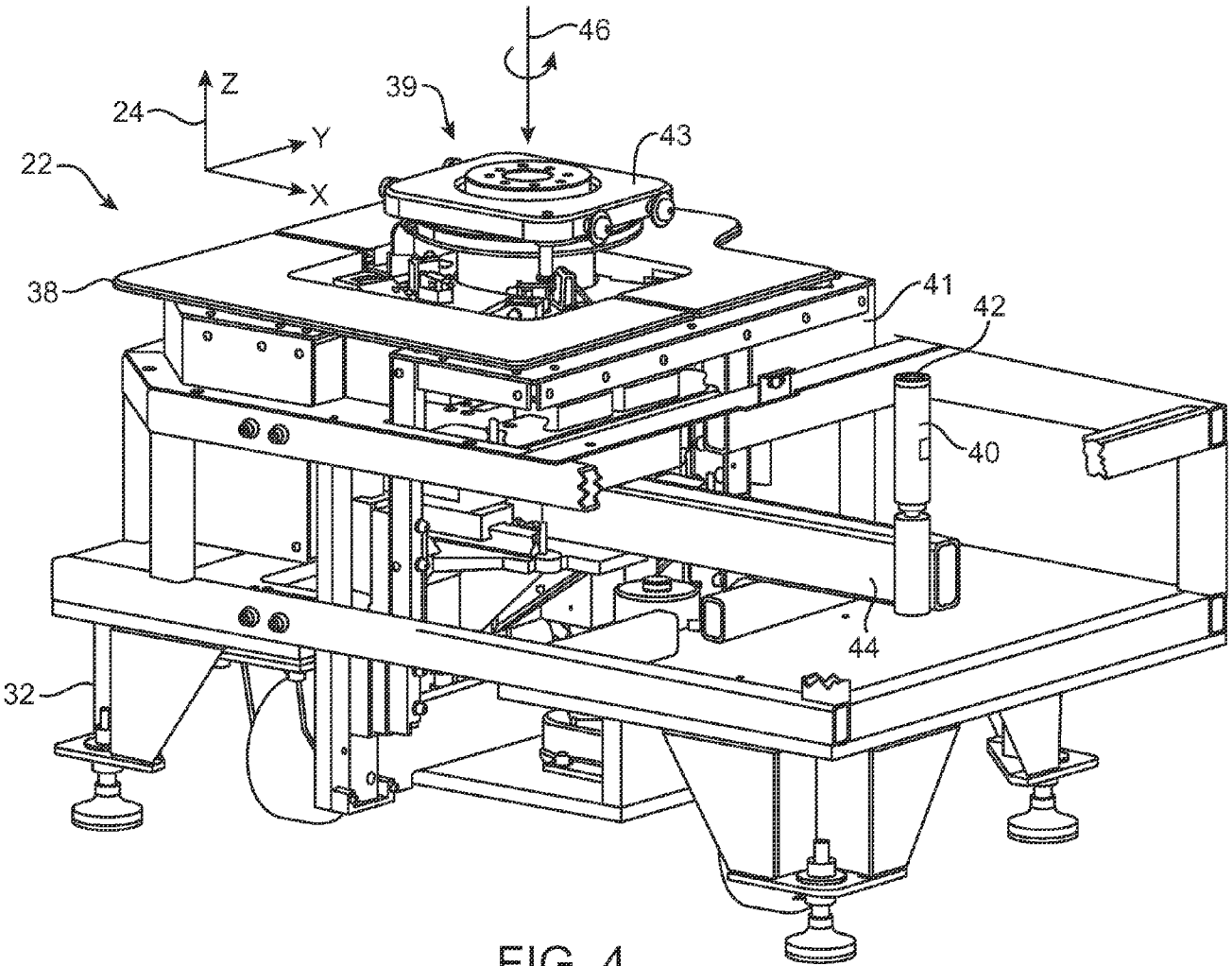
FIG. 4 is a perspective view of a movement mechanism, linkage and stabilizing member in accordance with embodiments, with portions of a frame removed for clarity.

Referring now to FIGS. 3 and 4, patient positioning system 14 can be seen in more detail. Patient positioning system 14 generally includes a patient support such as a chair 20, a base 32, patient positioning mechanism 22 and a support member such as arm 40. Base 32 supports patient chair 20 and patient positioning mechanism 22. Patient positioning mechanism 22 connects patient chair 20 with base 32. Patient positioning mechanism 22 generally includes a linkage 38, often having joints and/or motors to accommodate or provide movement of patient chair 20 in relation to laser beam 18. Support arm 40 generally provides additional support to patient chair 20. Support arm 40 can be mounted to either base 32 or positioning mechanism 22.

The patient chair generally comprises a chair, seat or bed or similar structure for supporting a patient in a seated, reclined or supine position. Chair 20 generally includes head pad 30 which supports the head of the patient. Chair 20 is generally attached to linkage 38 at attachment locus 39, and a first portion such as hip portion 34 of chair 20, which is adjacent to the attachment locus. Hip portion 34 is supported at attachment locus 39 by linkage 38 so as to allow chair 20 to rotate about base 32 with an axis of rotation 46 passing through base 32. Axis 46 is located near and often passes through hip portion 34 of patient chair 20. Chair 20 generally pivots or rotates about axis 46 to permit loading and unloading of the patient. By swinging head pad 30 and an upper portion of chair 20 out from under laser system 12, the patient can be more easily loaded onto chair 20. After the patient has reclined in chair 20, the chair is then rotated about axis 46 to position the head of the patient and patient head pad 30 under laser system 12. Exemplary supports are commercially available from Advanced Medical Optics, Inc (formerly VISX, Inc.) of Santa Clara, Calif.

Chair 20 can be contoured to receive the patient. Contouring of chair 20 can be designed to receive a nominal patient having a nominal center of gravity 50. In many instances, nominal center of gravity 50 (and/or the actual center of gravity of the patient) is not coincident with attachment locus 39, resulting in cantilever effects. Cantilever effects are generally undesirable and can be associated with system instability and motion. For example, nominal center of gravity 50 can apply torque to attachment locus 39 and linkage 38 while a nominal patient is reclined on chair 20. This torque can result in lever motion of chair 20 by rotating the chair about attachment locus 39 and linkage 38. This lever motion of the chair may cause undesirable movement and displacements of the patient's feet, and in particular the patient's head near laser beam 18.

Providing support to a second portion of chair 20 such as shoulder portion 36 can reduce or eliminate cantilever effects. The second portion of chair 20 is often located toward head pad 30 from the nominal center of gravity 50, in exemplary embodiments being disposed adjacent a nominal, chest, shoulder, neck, or head portion of the chair. Shoulder portion 36 can be located on chair 20 such that providing additional support to this location will reduce cantilever effects. The nominal center of gravity is often located between hip portion 34 and shoulder portion 36 of chair 20. Nominal center of gravity 50 of the patient is also often positioned between load bearing surface 42 and axis of rotation 46. This location of the nominal patient center of gravity between the supported portions 34 and 36 may result in decreased cantilever loading at attachment locus 39 and linkage 38, thereby improving stability of patient chair 20 and reducing patient motion.

Patient positioning mechanism 22 generally includes linkage 38 and provides rotation of the patient support about axis of rotation 46. Mechanism 22 and base 32 may generally comprise a pedestal. In many embodiments, base 32 is positioned beneath hip portion 34 and shoulder portion 36 of patient chair 20. Linkage 38 movably supports the patient chair, and often provides controlled motion of the patient chair in response to user input from input device 19. Linkage 38 can be attached to hip portion 34 of chair 20 at attachment locus 39. The patient chair is movable along a horizontal XY plane transverse to laser beam 18. In some embodiments, linkage 38 includes a horizontal XY motion stage 43 and a vertical Z motion stage 41. Base 32 can support vertical Z motion stage 41, and vertical Z motion stage 41 can be mounted to base 32. Vertical Z motion stage 41 may move linkage 38 vertically along dimension Z normal to the horizontal XY plane in a direction generally parallel to the laser beam. Horizontal XY motion stage 43 can be mounted to vertical Z motion stage 41. In these embodiments, vertical Z motion stage 41 can support horizontal XY motion stage 43, attachment locus 39 and hip portion 34 of the patient support. Vertical motion stage 41 can simultaneously move both XY motion stage 43, attachment locus 39, and hip portion 34 of the patient support in a vertical Z direction normal to the horizontal XY plane. Horizontal XY motion stage 43 can move attachment locus 39 and hip portion 34 of patient chair 20 along X and Y axes in the horizontal XY plane, which is generally perpendicular and/or transverse to laser beam 18. Three dimensional motion can be effected by combined motion of the vertical Z motion stage and the horizontal XY motion stage. As patient chair 20 is often rigid, support and motion of the hip portion of the patient support will generally effect support and motion of the entire patient support. However, this limited support may result in unintended patient motion and cantilever effects as discussed above.

Figure 4A:
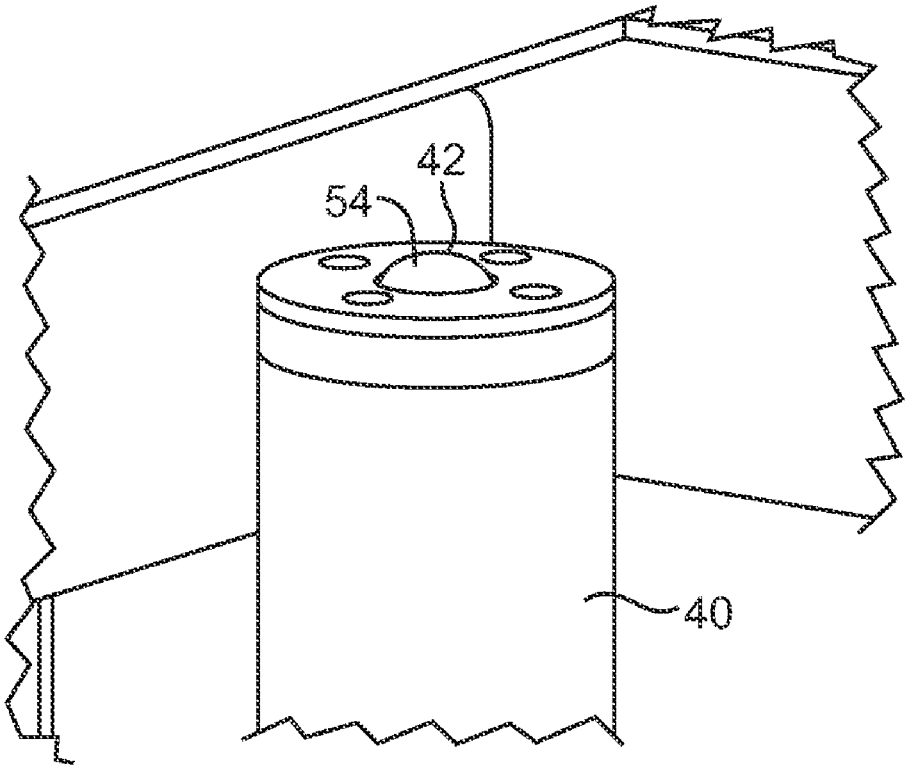
FIG. 4A is an enlarged perspective view of the stabilizing member and load bearing surface shown in FIG. 4.

Referring now to FIG. 4A, an enlarged perspective view of the stabilizing member and load bearing surface are shown. Arm 40 includes a rotating ball 54 which has load bearing surface 42 located thereon. In exemplary embodiments, a flat plate 52 is positioned at the bottom of the shoulder portion of chair 20. Load bearing surface 42 engages flat plate 52. Flat plate 52 engages rotating ball 54 and rotating ball 54 supports flat plate 52. Rotating ball 54 rotates and supports flat plate 52 while chair 20 moves in the horizontal XY plane. Rotating ball 54 and arm 40 remain at a fixed location while chair 20 moves in the horizontal XY plane. In alternate embodiments, a stationary flat plate can remain at a fixed location and support a rotating ball. In this embodiment, the rotating ball is fixed to the shoulder portion of the chair, and the rotating ball moves with the shoulder portion of the chair while the shoulder portion of the chair moves in the horizontal XY plane.

Figure 5:
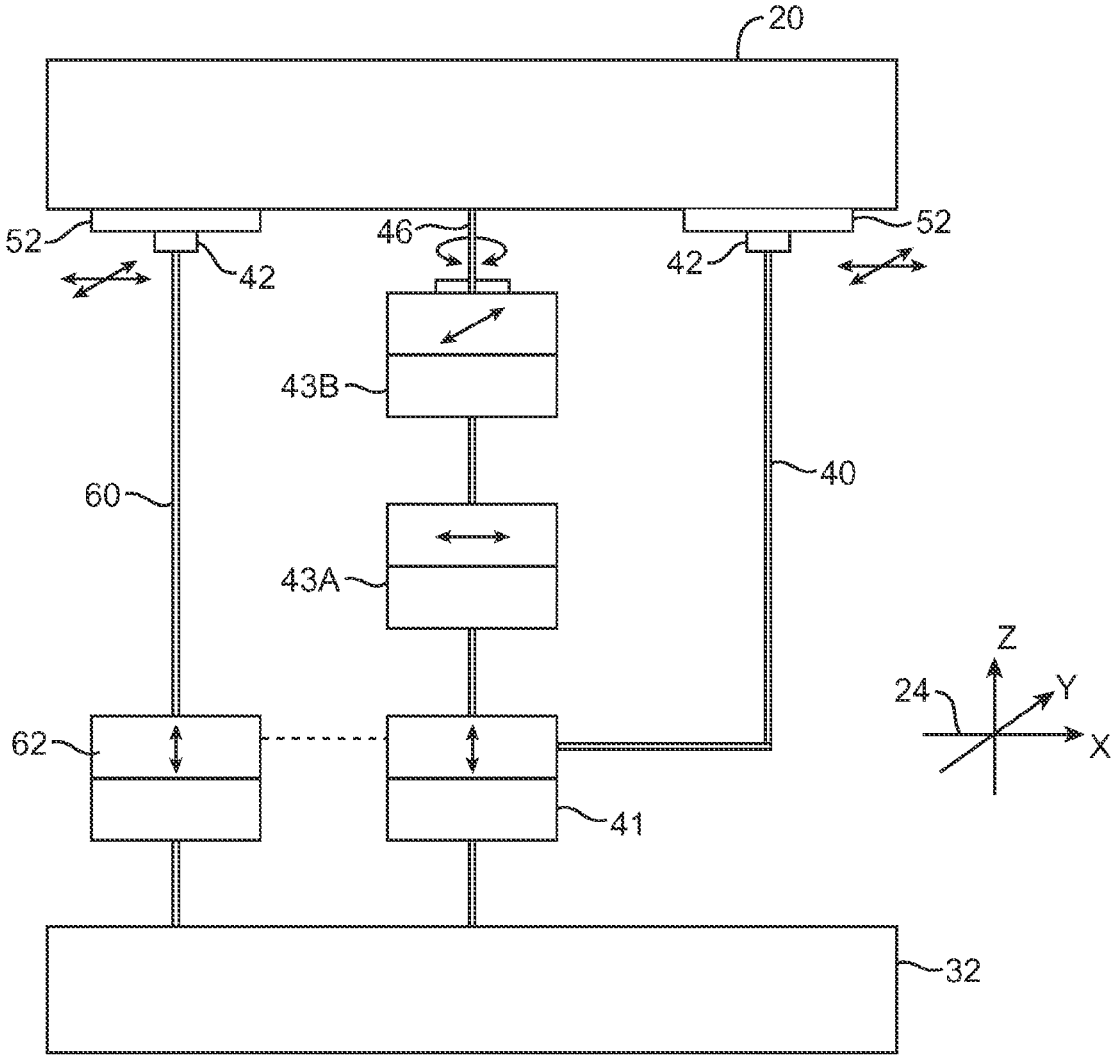
FIG. 5 is a schematic side view showing some of the structural support and degrees of freedom of the support system of FIG. 2 in accordance with embodiments.
Figure 6:
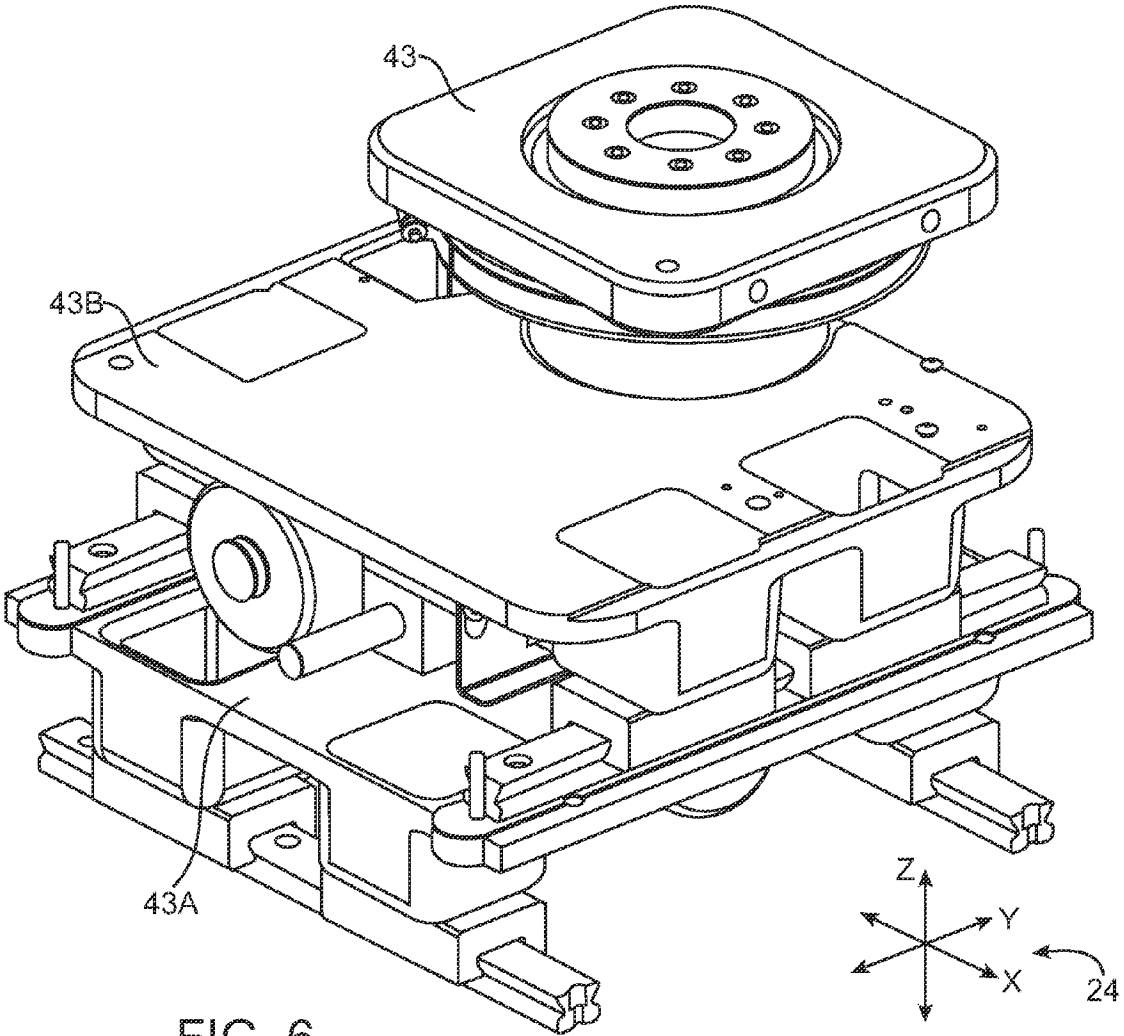
FIGS. 6 and 7 are perspective views of the driven linkage components of FIGS. 2-5 in accordance with embodiments.
Figure 7:
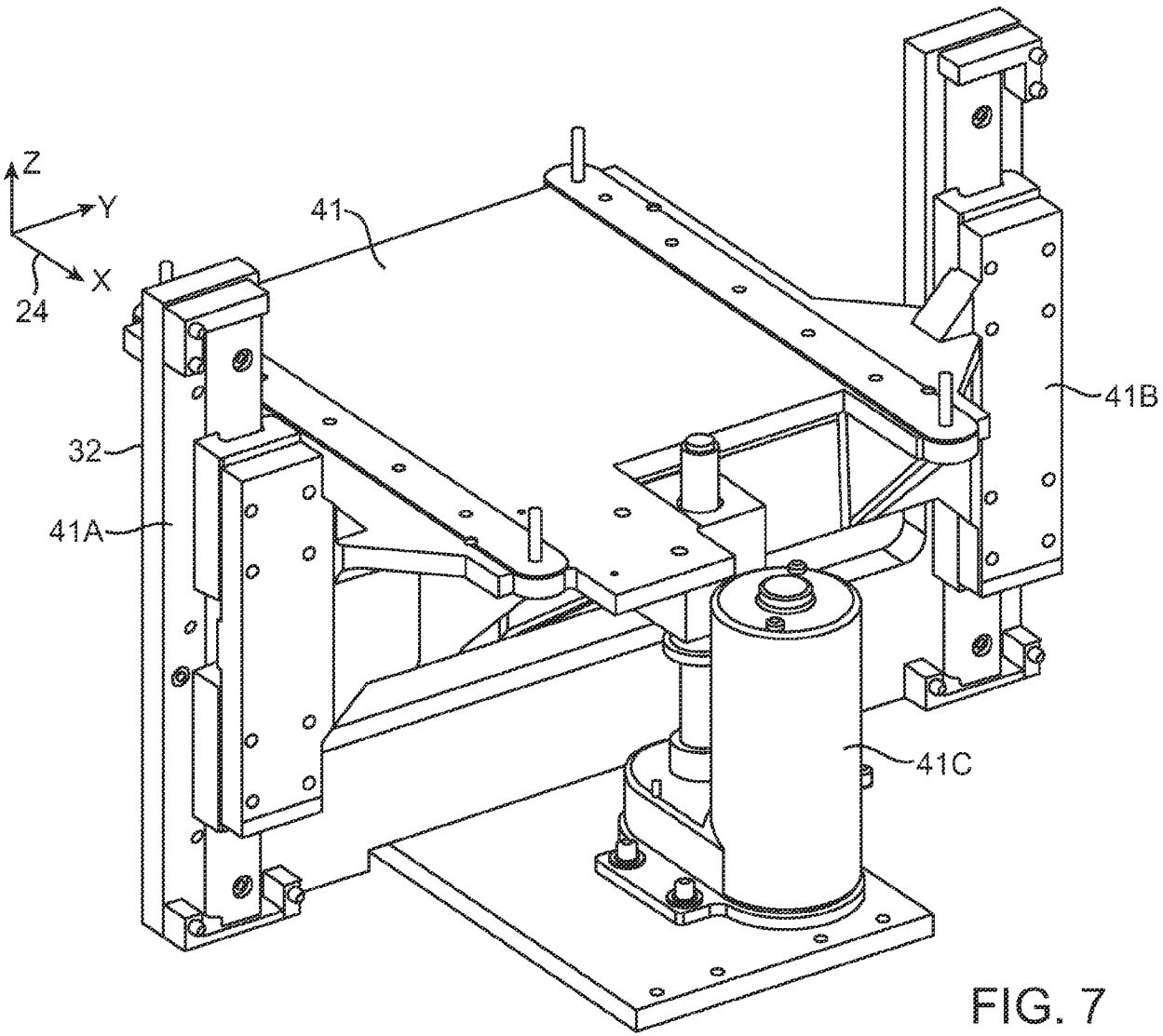

Referring now to FIGS. 5, 6 and 7 vertical Z motion stage 41 and horizontal XY motion stage 43 of linkage 38 are shown in greater detail in accordance with a preferred embodiment. As shown in FIGS. 5 and 7 vertical Z motion stage 41 includes a first vertical linear translation stage 41A and a second vertical linear translation stage 41B. A motor 41C drives vertical Z motion stage 41 up and down. As shown in FIGS. 5 and 6, XY horizontal motion stage 43 can include an X linear translation stage 43A and a Y linear translation stage 43B. By appropriately mounting X translation stage 43A perpendicular to Y translation stage 43B, XY horizontal motion stage 43 can be provided as shown in FIG. 6. XY horizontal motion stage 43 is rigidly mounted to vertical motion stage 41 so that vertical motion of vertical motion stage 41 provides vertical motion of XY stage 43. As can be understood with reference to FIGS. 4, 5 and 7, arm 40 can be rigidly mounted to vertical motion stage 41 so that vertical motion of vertical motion stage 41 provides vertical motion of arm 40. Motion of X and Y translation stages 43A, 43B, is accommodated by X and Y sliding or rolling motion between plate 52 and a load bearing surface 42. The plate and bearing surface 42 may disengage when chair 20 rotates about axis 46 for loading and unloading the patient. An alternative support member comprises an articulated support member 60 having a joint 62 that moves in correlation with the vertical motion stage as shown in FIG. 5 and described in more detail with reference to FIG. 9 below.

Referring again to FIGS. 3, 4 and 5, support arm 40 is generally positioned beneath shoulder portion 36 of chair 20 so as to support shoulder portion 36 and reduce instability and cantilever effects as described above. Arm 40 has load bearing surface 42. Load bearing surface 42 supports shoulder portion 36 of the patient chair. Load bearing surface 42 is often located toward head support 30 from hip portion 34 of the patient support. Linkage 38 moves the patient support along the horizontal XY plane. Arm 40 is often decoupled from horizontal XY motion of linkage 38. Thus, the patient chair can move along the horizontal XY plane while arm 40 remains at a fixed location. Linkage 38 moves patient chair 20 normal to the horizontal XY plane along dimension Z. While reference has been made to horizontal and vertical motion and X, Y and Z coordinate references, other motion and coordinate references can be used. For example, embodiments can use inclined or vertical planar motion, as with an upright chair and a generally horizontal laser beam directed at a patient seated in a chair, and inclined and non-orthogonal coordinate references.

In many embodiments, load bearing surface 42 is separated from axis 46 and hip portion 34 of patient chair 20 by a distance 48 of at least one foot. In preferred embodiments, load bearing surface 42 is located near the shoulder blades of the patient.

While linkage 38 may be capable of moving or even supporting a chair (or other patient support) when the patient is resting thereon, significant deflection of the chair, the linkage structure, or even the base may occur. This deflection can be particularly significant near the head or feet of the patient, which are often separated from the motor-driven linkage by a significant lateral distance. At least a portion of this deflection may be attributed to cantilever effects from having the patient supporting linkage disposed at a location separated from the patient's center of gravity, while the head (for example) of the patient is supported by the portion of the chair that extends laterally. In some embodiments, it may be desirable to position the linkage near or coincident with the center of gravity to limit the bending moments on the motion stages of the linkage. Even in these embodiments, an additional support member can stabilize the patient support by providing the additional support member at a location separated and/or offset from the linkage.

To inhibit excessive deflection of the chair and movement of the patient's head, a structural support member may reinforce patient chair 20. As can be seen in FIG. 4, exemplary arm 40 comprises a lateral support beam 44. Beam 44 extends from vertical Z motion stage 41 toward support arm 40. Beam 44 rigidly attaches support arm 40 to vertical Z motion stage 41 of linkage 38. Vertical Z motion stage 41 can support beam 44, arm 40, chair 20, and horizontal XY motion stage 43. Vertical Z motion stage 41, arm 40, chair 20, and horizontal XY motion stage 43 move together vertically along dimension Z. Arm 40 can be rigidly attached to vertical Z motion stage 41 with beam 44. Consequently, horizontal XY motion stage 43 does not move arm 40. Horizontal XY motion stage 43 moves chair 20 in the horizontal XY plane, and horizontal XY motion of chair 20 occurs while arm 40 remains at a fixed location.

Figure 8:
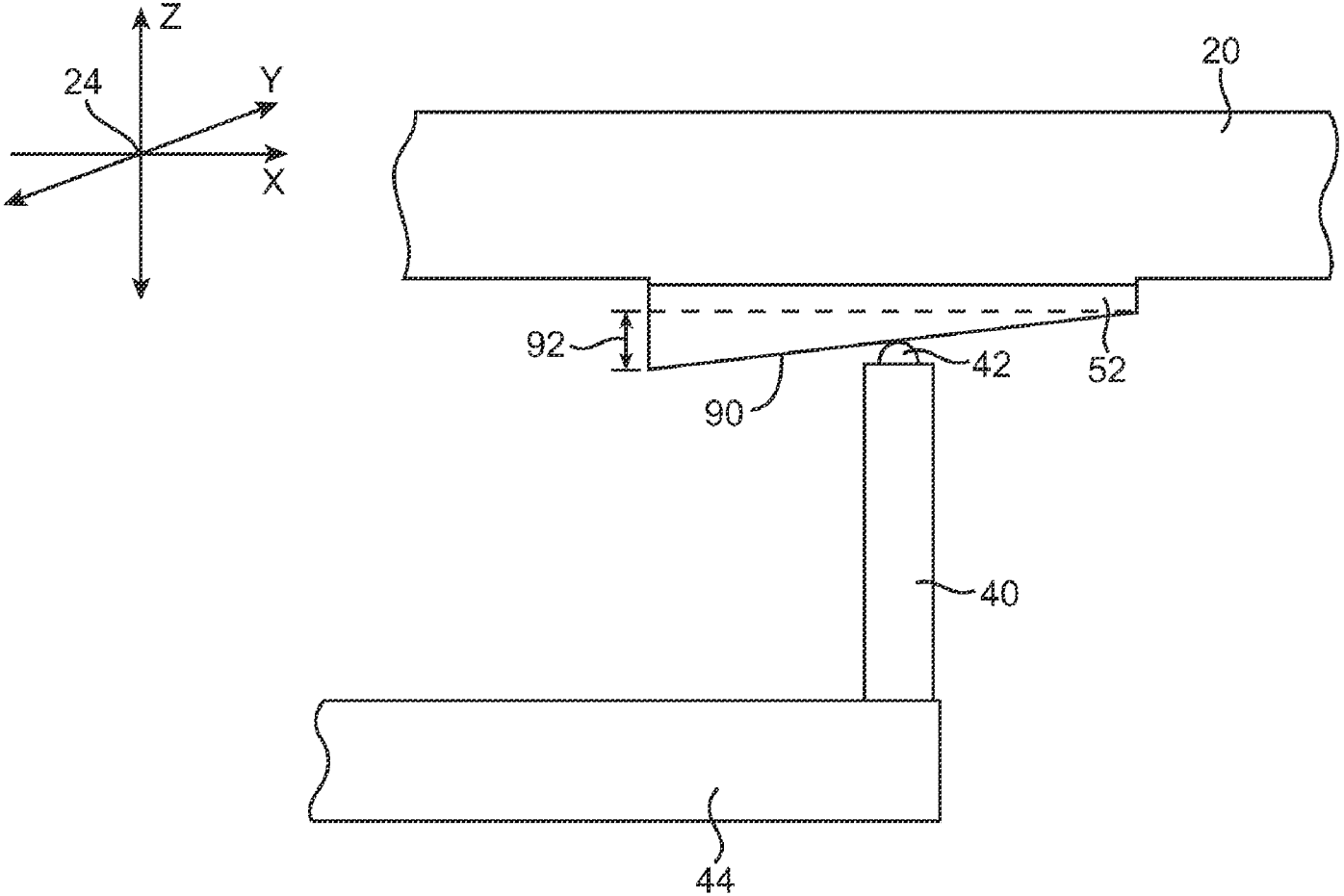
FIG. 8 is a plan view of a plate with a planar surface with an angular deflection which compensates for slight deflections of the support arm, in accordance with embodiments.

In some embodiments, arm 40 is deflected slightly as chair 20 moves along dimension X in the XY plane, and this deflection can be compensated by providing a surface 90 of plate 52 which is at a slight angle to the XY plane as shown in FIG. 8. This deflection can arise where the patient center of gravity is displaced from the center of the chair and/or base 32, and load bearing surface 42 has an increasing load as the patient moves along the X dimension of chair coordinate reference 24. Because beam 44 can extend over a distance from vertical Z motion stage 41 to arm 40, increased loading of arm 40 causes increased loading of beam 44 and vertical Z motion stage 41. This increased loading of beam 44 and vertical Z motion stage 41 can result in deflection of arm 40. A nominal patient having a nominal center of gravity will result in a nominal deflection of arm 40 per unit distance along dimension X. Plate 52 can be provided with surface 90 which is deflected at a slight angle to the XY plane. Surface 90 has an increase in height 92 per unit distance along dimension X which matches the nominal deflection of arm 40. Because this increase in height per unit distance matches the nominal deflection of arm 40, as chair 20 moves along dimension X chair 20 remains in the XY plane, even though arm 40 has deflected slightly. Alternate embodiments can be provided which have less deflection of the support arm as the chair moves along the X dimension.

Figure 9:
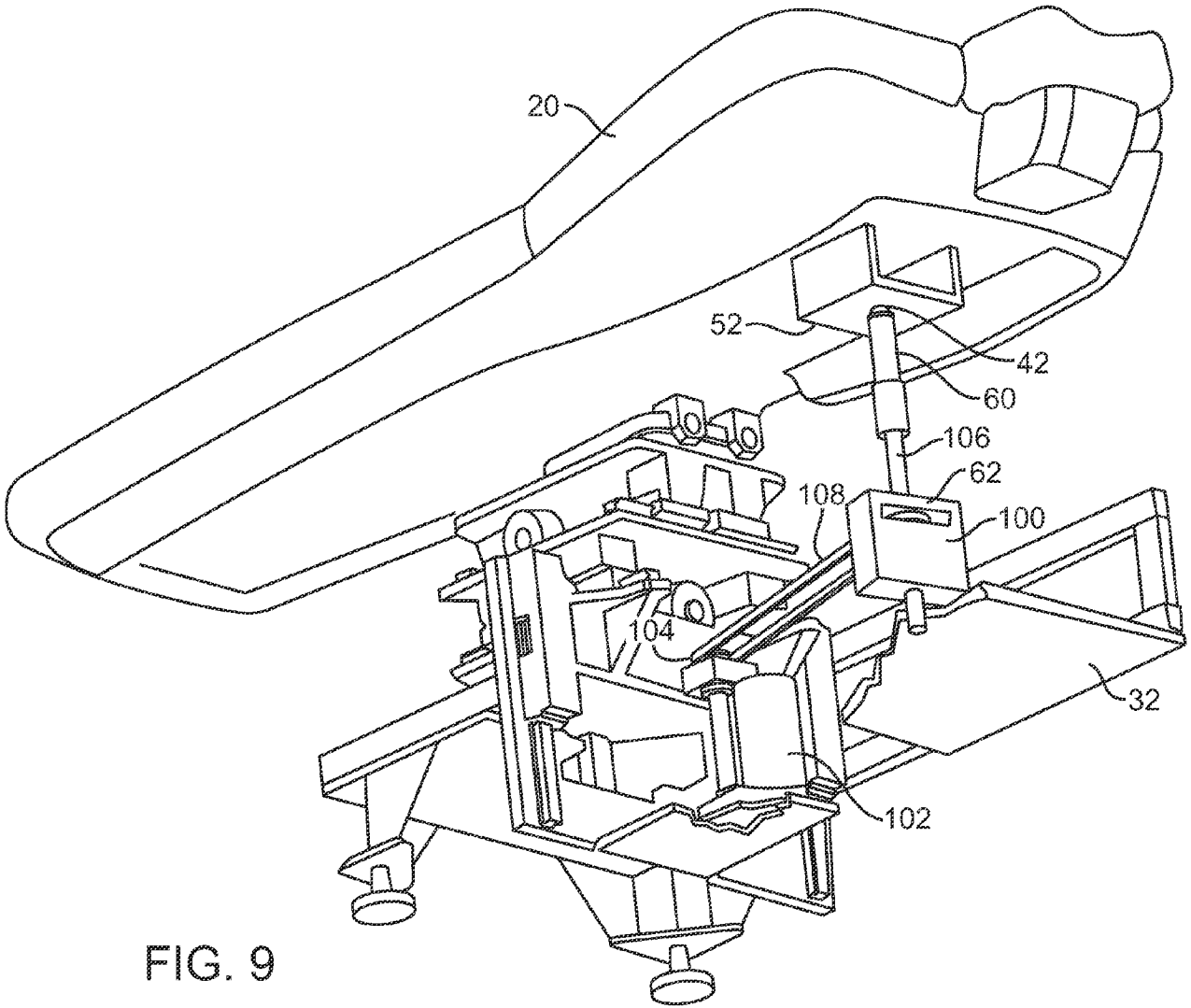
FIG. 9 is a perspective view of a stabilizing member mounted to a base in accordance with alternate embodiments of the present invention.

FIG. 9 illustrates an alternate embodiment in which the structural member and the vertical Z motion stage shown above are separately driven along the vertical Z dimension at a angle normal to the horizontal XY plane. The structural member here comprises an articulated support structure 100 that is rigidly attached to base 32 as described above. A threaded rod 106 of articulated support structure 100 movably supports arm 60 and load bearing surface 42. Rotation of rod 106 threadedly engages support structure 100 at joint 62 as described above in FIG. 5. This rotation of rod 106 moves arm 40 and load bearing surface 42 vertically along dimension Z at an angle normal to the horizontal XY plane. Load bearing surface 42 engages plate 52. Plate 52 is rigidly attached to chair 20 and permits horizontal XY motion of chair 20 and plate 52 while load bearing surface 42 and support arm 40 remain at a fixed location. Plate 52 can be used with any of the embodiments as described above. In some embodiments, a motor 102 drives a sprocket 104 and chain 108 to rotate threaded rod 106. Motor 102 is electrically coupled to the vertical Z motion stage of the linkage shown above such that the rotation of threaded rod 106 and resulting movement of the arm normal to the horizontal XY plane is synchronous with movement of the vertical Z motion stage as described above. In alternate embodiments, rotating rod 106 may be mechanically coupled to the motor which drives the vertical Z motion stage vertically to synchronously drive arm 40 with the Z motion stage of the linkage as described above.

While the exemplary embodiments have been described in some detail for clarity of understanding and by way of example, a variety of additional modifications, adaptations, and changes may be clear to those of skill in the art. Hence, the scope of the present invention is limited solely by the appended claims.

What is claimed is:

1. A method of stabilizing a patient support for laser refractive surgery, the method comprising:

supporting the patient support with a linkage having a first end attached to a base and a second end attached to a first portion of the support;

supporting a second portion of the patient support with a bearing surface of a member;

moving the patient support within a plane by articulating the linkage while the bearing surface of the member remains at a fixed location relative to the plane;

moving the first portion of the patient support at an angle to the plane by moving a vertical motion stage of the linkage at the angle to the plane; and moving the member at the angle to the plane synchronous with the moving of the vertical motion stage by coupling the moving of the member to the moving of the vertical motion stage.

2. The method of claim 1 further comprising:

moving the patient support and the member at an angle to the plane by moving a vertical motion stage of the linkage;

moving the patient support within the plane by moving the a horizontal motion stage of the linkage; and supporting the member with the horizontal motion stage while the patient support moves within the plane and the vertical motion stage and the member remain at a fixed location in relation to the plane.

3. The method of claim 1 further comprising loading the support with a patient having a center of gravity located between the first portion of the support and the second portion of the support.

4. The method of claim 1 further comprising rotating the support about an axis of rotation passing through the base.

5. The method of claim 1 further comprising movably engaging the bearing surface with a flat plate affixed to the patient support.

6. The method of claim 5 further comprising rotating a ball comprising the bearing surface.

7. The method of claim 1 further comprising rotating a threaded rod to move the member at the angle to the plane such that the such that the member moves at the angle to the plane synchronous with the vertical motion stage.

* * * * *